US008231245B2

(12) United States Patent
Weimer et al.

(10) Patent No.: US 8,231,245 B2
(45) Date of Patent: Jul. 31, 2012

(54) LED LIGHTING FIXTURE

(75) Inventors: David Weimer, Tuckerton, NJ (US); Chakrakodi Vishnu Shastry, Princeton, NJ (US); Gordon Routledge, Bradley (GB); Samual David Boege, Point Pleasant, NJ (US); William S. Leib, III, Tinton Falls, NJ (US)

(73) Assignee: Dialight Corporation, Farmingdale, NJ (US)

( * ) Notice: Subject to any disclaimer, the term of this patent is extended or adjusted under 35 U.S.C. 154(b) by 61 days.

(21) Appl. No.: 12/370,871

(22) Filed: Feb. 13, 2009

(65) Prior Publication Data

US 2010/0208458 A1 Aug. 19, 2010

(51) Int. Cl.
*F21V 1/00* (2006.01)

(52) U.S. Cl. ..... 362/249.02; 362/249.11; 362/800; 362/294; 362/373

(58) Field of Classification Search ..... 362/800, 362/373, 294, 249.02, 249.11, 235
See application file for complete search history.

(56) References Cited

U.S. PATENT DOCUMENTS

| | | | | |
|---|---|---|---|---|
| 6,659,623 | B2 * | 12/2003 | Friend | 362/249.06 |
| 6,871,981 | B2 * | 3/2005 | Alexanderson et al. | 362/294 |
| 6,880,952 | B2 * | 4/2005 | Kiraly et al. | 362/218 |
| 6,932,495 | B2 * | 8/2005 | Sloan et al. | 362/294 |
| 7,063,440 | B2 * | 6/2006 | Mohacsi et al. | 362/240 |
| 2005/0190553 | A1 | 9/2005 | Lynch | |
| 2008/0094005 | A1 | 4/2008 | Rabiner | |
| 2010/0061095 | A1 * | 3/2010 | Hoffmann | 362/235 |

OTHER PUBLICATIONS

PCT Search Report and Written Opinion for PCT/US2010/023920, Jun. 15, 2010, copy consists of 11 unnumbered pages.
International Preliminary Report on Patentability for PCT/US2010/023920, Aug. 25, 2011, copy consists of 7 unnumbered pages.

* cited by examiner

*Primary Examiner* — Anabel Ton

(57) ABSTRACT

The present invention relates generally to a light emitting diode lighting fixture. In one embodiment, the light fixture includes an extrusion, a plurality of light emitting diodes (LEDs) and a lens coupled to the extrusion. The plurality of LEDs has a uniform spacing between each one of the plurality of LEDs along the extrusion.

18 Claims, 6 Drawing Sheets

LED LIGHTING FIXTURE

FIELD OF THE INVENTION

The present invention relates generally to a lighting fixture, and more specifically, to lighting fixtures that utilize light emitting diodes.

BACKGROUND OF THE INVENTION

Current light emitting diode (LED) lighting technology creates issues of glare and uniformity when designed to be longer than that of a typical extrusion. When two or more light fixtures currently used in the prior art are connected, they are typically not connected end to end. Moreover, the LEDs are not spaced evenly, i.e. there is an offset in the lighting pattern. The lack of symmetry may create undesirable lighting properties. In addition, hot spots may be created along the light fixture.

In addition, current LED lighting technology is generally difficult to mount in existing cabinets, coves or under cabinets where mounting is difficult. For example, the use of external brackets is not easily accessed. Moreover, the external brackets may add undue height to the overall fixture size.

SUMMARY OF THE INVENTION

The present invention relates generally to a light emitting diode lighting fixture. In one embodiment, the light fixture comprises an extrusion, a plurality of light emitting diodes (LEDs) having a uniform spacing between each one of said plurality of LEDs along said extrusion and a lens coupled to said extrusion.

The present invention also provides an end-to-end connector for coupling multiple light fixtures. In one embodiment, the end-to-end connector comprises a spacer, a first side coupled to said spacer for coupling to a first light fixture, said first side comprising a first one or more connecting pins coupled to said first side of said spacer and a first one or more alignment posts coupled to said first side of said spacer and a second side coupled to said spacer for coupling to a second light fixture, said second side comprising a second one or more connecting pins coupled to said first side of said spacer and a second one or more alignment posts coupled to said first side of said spacer.

The present invention also provides a second embodiment for an end-to-end connector for coupling multiple light fixtures. In one embodiment, the end-to-end connector comprises a first interface for coupling to a first light fixture, a flexible cord coupled to said first interface and a second interface for coupling to a second light fixture, wherein said end-to-end connector aligns said first light fixture and said second light fixture in parallel.

BRIEF DESCRIPTION OF THE DRAWINGS

So that the manner in which the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

Figure 1:
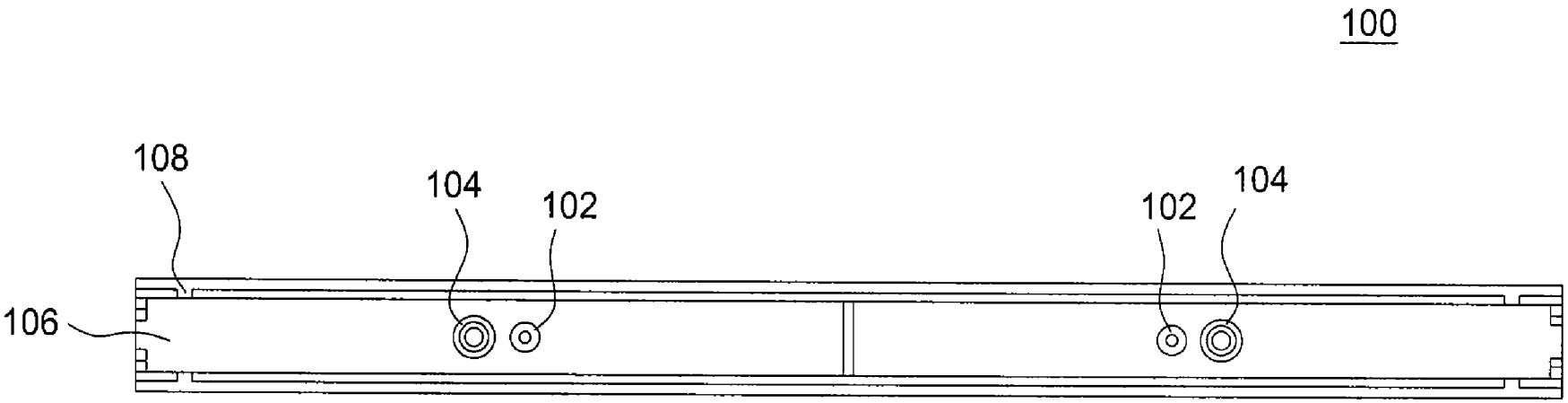
FIG. 1 depicts a top view of one embodiment of a light fixture.

FIG. 1 illustrates a top view of one embodiment of a light fixture 100. In one embodiment, the light fixture comprises a plurality of light emitting diodes (LEDs) 102, mounting holes 104, a lens 106 and an extrusion 108. Although FIG. 1 illustrates the light fixture 100 having only two LEDs 102 and two mounting holes 104, one skilled in the art will recognize that the light fixture 100 may have any number of LEDs 102 and mounting holes 104.

In one embodiment, the plurality of LEDs 102 are uniformly spaced. This provides a symmetric illumination pattern on a targeted illumination area and prevents hot spots from forming along the light fixture 100. The uniform spacing may be any length that maintains symmetric illumination patterns and that does not generate any shadowing or dark spots on the targeted illumination area. In one embodiment, the uniform spacing between each one of the plurality of LEDs 102 may be between 100 millimeters (mm) to 500 mm. For example, the uniform spacing between each one of the plurality of LEDs 102 may be approximately 200 to 300 mm.

In one embodiment, the light fixture 100 also includes one or more mounting holes 104. Notably, the mounting holes 104 are designed into the light fixture 100. More specifically, the mounting holes 104 are located through the lens 106 and the extrusion 108. This allows the light fixture 100 to have an ultra low profile that is advantageous for cabinet lighting, under cabinet lighting and cove lighting. In other words, the light fixture 100 does not require additional external brackets that add to an overall height profile of the light fixture 100.

In addition, the mounting holes 104 are strategically placed in the light fixture 100. More specifically, the mounting holes 104 are spaced relative to the plurality of LEDs 102 such that a light output of each one of the plurality of LEDs 102 is not hindered. For example, the mounting holes 104 are positioned to maximize optical efficiency of the plurality of LEDs 102. For example, proper placement of the mounting holes 104 prevents glare from the plurality of LEDs 102. In addition, the mounting holes 104 are positioned to prevent shadowing effects and dark spots on the targeted illumination area.

In one embodiment, the relationship of the distance (d) of the mounting holes 104 with respect to the plurality of LEDs 102 may be approximately given as follows in Equation (1):

$$\mathrm{TAN}(90-\sigma)=h/d \tag{1}$$

Figure 8:
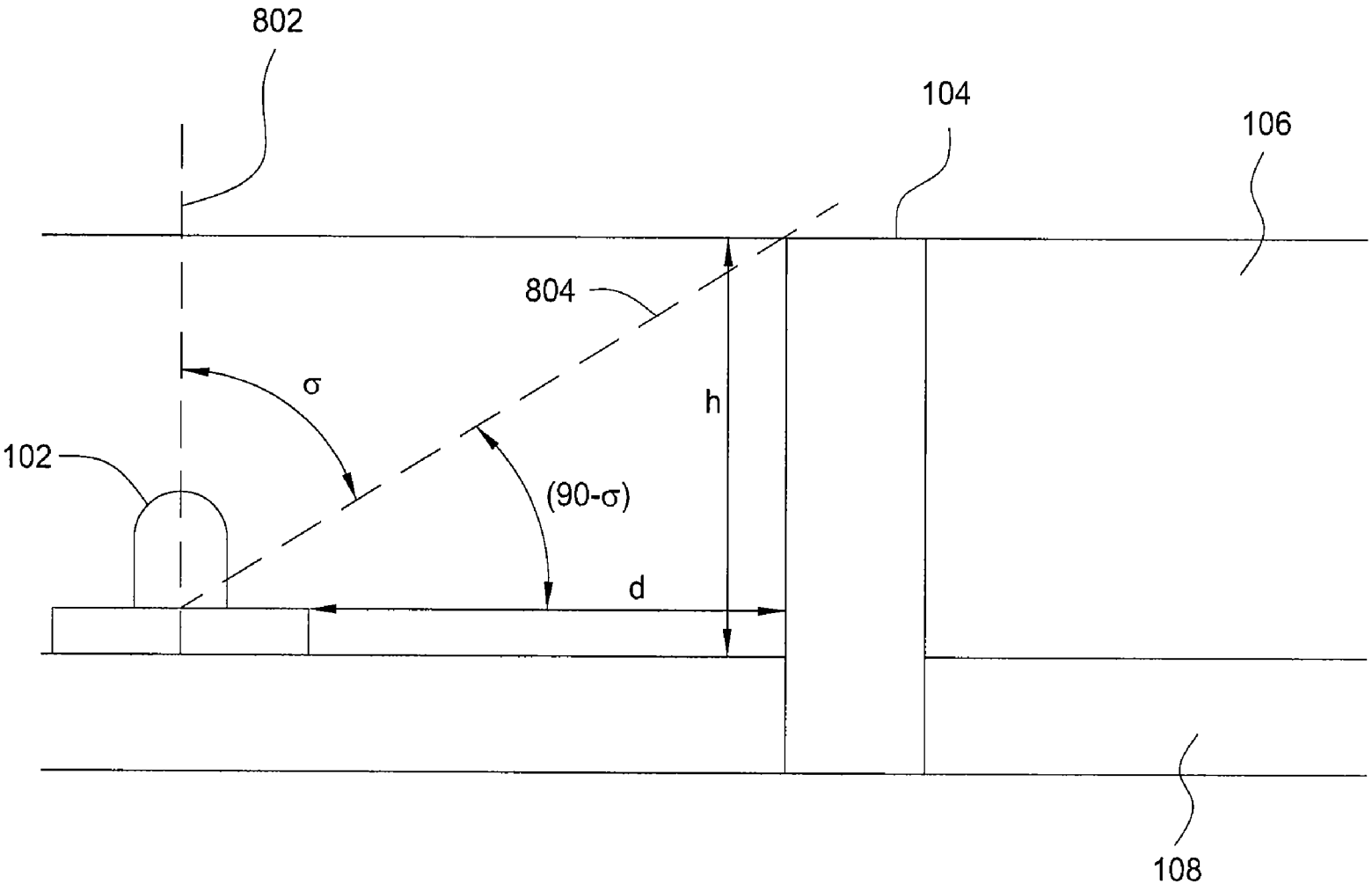
FIG. 8 depicts one embodiment of a relationship defining a distance between a light emitting diode and a mounting hole.

One embodiment of Equation (1) is illustrated by FIG. 8. FIG. 8 illustrates one of the plurality of LEDs 102 (hereinafter referred to interchangeably as LED 102) and one of the mounting holes 104 (hereinafter referred to interchangeably mounting hole 104) placed adjacent to the LED 102. The LED 102 sits on top of the extrusion 108 and under the lens 106.

In Equation (1) illustrated in one embodiment by FIG. 8, h represents a height of the mounting hole 104 from a top of the extrusion 108, d represents the distance between the LED 102 and the mounting hole 104. The symbol σ represents a viewing angle of light from the LED 102. The symbol a may also represent a viewing angle of light from a combination of the LED 102 and a secondary optic (not shown). For example, a may be an angle of light emitted from the LED 102 spanning from a vertical axis represented by a dashed line 802 of light emitted by one of the plurality of LEDs 102 to the top of the mounting hole 104 represented by a dashed line 804. The term 90−σ represents the angle of light blocked by the height of the mounting hole 104.

Generally, the height h of the mounting hole 104 is known. Thus, a may be calculated based on a given height h of the mounting hole 104. As a result, an approximate distance d for achieving the design goals may be calculated by re-writing Equation (1) above, as follows in Equation (2):

$$d=h/\mathrm{TAN}(90-\sigma) \tag{2}$$

In Equation (2), h is a known height of the mounting hole 104 and a may be calculated based on the known height of the mounting hole 104.

Figure 2:
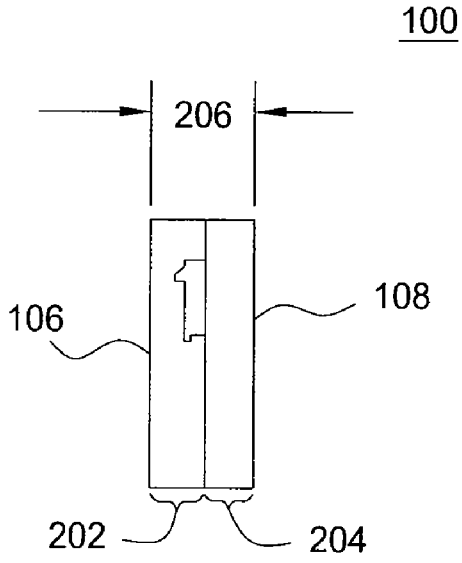
FIG. 2 depicts a side view of one embodiment of the light fixture.

Also adding to the ultra low profile of the lighting fixture 100 is the design of the lens 106 and the extrusion 108. FIG. 2 illustrates a side view of the lighting fixture 100 that helps to illustrate the design profile of the lens 106 and the extrusion 108. In one embodiment, a height 202 of the lens 106 is greater than a height 204 of the extrusion 108. In other words, the ratio of the height 202 of the lens 106 to the height 204 of the extrusion 108 is greater than one. In addition, a combined height 206 of the height 202 of the lens 106 and the height 204 of the extrusion is less than one inch. In one embodiment, the combined height may be less than 0.5 inches.

In achieving the above height ratio between the lens 106 and the extrusion 108, the extrusion 108 may function as a flat heat sink. The thickness of the heat sink, and thereby the extrusion 108, may be a function of a spacing length of the uniform spacing the plurality of LEDs 102. For example, as the length of the uniform spacing between the plurality of LEDs 102 increases, the thickness of the heat sink and the extrusion 108 will decrease. Conversely, as the length of the uniform spacing between the plurality of LEDs 102 decreases, the thickness of the heat sink and the extrusion 108 will increase.

In one embodiment the lens 106 may be fabricated from polycarbonate. However, one skilled in the art will recognize that any optical grade material may be used.

In addition, the lens 106 may include various optical features depending on the application of the lighting fixture 100. In one embodiment, a masking (now shown) may be applied on both sides along a length of the lens 106. The masking helps to achieve a narrower angle of light output from the plurality of LEDs 102 and helps to prevent glare.

In addition, a color added pigment recipe may be included in the lens 106 depending on the various lighting requirements. The pigment may be used to precisely control the direction of the photons emitted from the plurality of LEDs 102. For example, the pigment may help to spread light more uniformly over a wider distance at a cost of lower efficiency.

The lens 106 may also be any shape in accordance with a desired application of the light fixture 100. In one embodiment, the lens 106 is a hemisphere shape to achieve the greatest pass through of light outputted by the plurality of LEDs 102. However, one skilled in the art will recognize that the lens 106 may be a different shape, for example, depending on if one desires the light output of the plurality of LEDs 102 to be wider or narrower.

Figure 3:
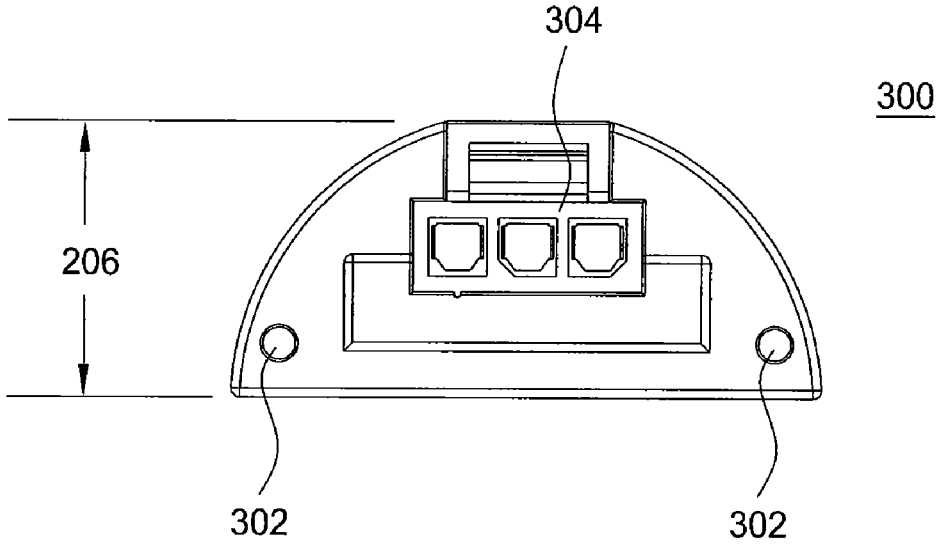
FIG. 3 depicts a front view of one embodiment of the light fixture.

FIG. 3 illustrates a front view of one end 300 of the light fixture 100. FIG. 3 also helps to illustrate the ultra low profile (i.e. the combined height 206 of the lens 106 and the extrusion 108 of the light fixture 100, as described above. One skilled in the art will recognize that an opposing end of the light fixture 100 will be substantially similar to the end 300 illustrated in FIG. 3.

In one embodiment, the end 300 comprises one or more holes 302 for receiving an alignment post of an end-to-end connector described below. The end 300 also comprises one or more holes 304 for receiving a connecting pin of the end-to-end connector, also further described below. The end 300 of the lighting fixture 100 is designed such that multiple light fixtures 100 may be coupled together in an end-to-end fashion. In doing so, an end-to-end connector is used to allow the uniform spacing of the plurality of LEDs 102 to be maintained between the multiple light fixtures 100.

Figure 4:
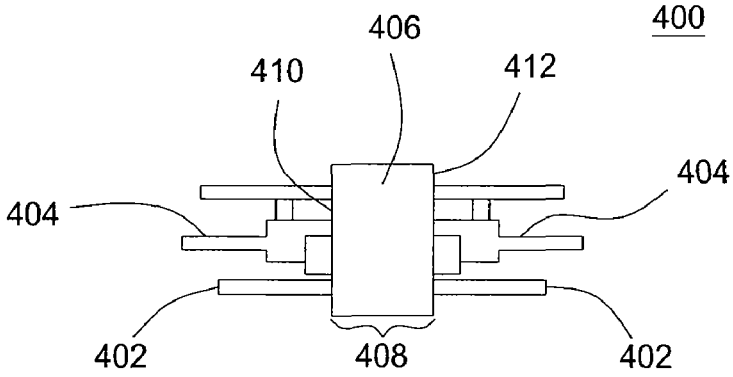
FIG. 4 depicts a side view of one embodiment of an end-to-end connector.

FIG. 4 illustrates one embodiment of an end-to-end connector. The end-to-end connector 400 comprises a spacer 406, a first side 410 coupled to the spacer 406 for coupling to a first light fixture 100 and a second side 412 coupled to the spacer 406 for coupling to a second light fixture 100. The spacer 406 may be made of any material. The spacer 406 may have a width such that when connecting two light fixtures 100, the LEDs 102 maintain a uniform spacing across the two light fixtures 100.

Figure 5:
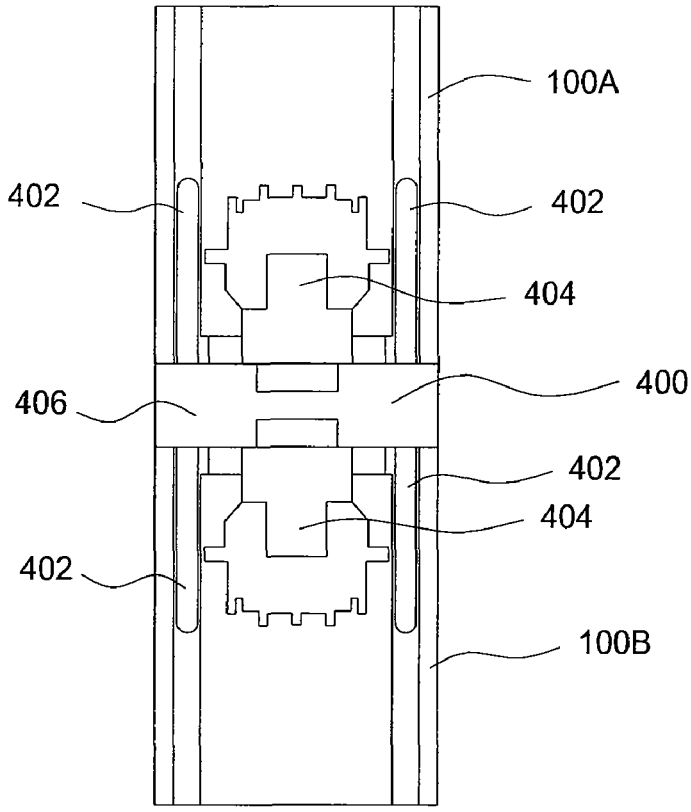
FIG. 5 depicts one embodiment of the end-to-end connector coupling two LED light fixtures.

The first side 410 and the second side 412 each comprises one or more alignment posts 402 and one or more connecting pins 404 coupled to the respective side. The alignment posts 402 are designed to bear most of stress and weight of the connection to a lighting fixture 100 as the connecting pin 404 may generally be a more delicate piece of hardware. In addition, the alignment posts 402 provide for easier alignment between the end-to-end connector 400 and the light fixture 100. As discussed above, the alignment posts 402 mate with the holes 302. Similarly, the connecting pins 404 mate with the holes 304. As a result, a flush connection is achieved between the light fixture 100 and the end-to-end connector 400. In one embodiment, the alignment posts 402 may be a single post that is pushed through the first side 410, the spacer 406 and the second side 412. FIG. 5 illustrates one embodiment of the end-to-end connector 400 coupled to two light fixtures 100A and 10B.

An important feature of the end-to-end connector 400 is that it maintains uniform spacing of the plurality of LEDs (not shown) between the multiple light fixtures 100A and 100B, as discussed above. More specifically, the uniform spacing is maintained between a last one of the plurality of LEDs (not shown) of a first light fixture 100A and a first one of the plurality of LEDs (not shown) of a second light fixture 100B. In other words, a length between each one of the LEDs across the first light fixture 100A and the second light fixture 100B is the same. Notably, multiple spacers 406 may be used to connect any number of light fixtures 100 end-to-end while maintaining uniform spacing between all of the LEDs.

In one embodiment, this is achieved by the spacer 406. Referring back to FIG. 4, a width 408 of the spacer 406 is a function of the desired uniform spacing between a plurality of LEDs of each light fixture 100A and 100B. For example, if the desired uniform spacing is approximately 275 mm, then the width 408 of the spacer 406 would be the precise length required to maintain the uniform 275 mm spacing between the last one of the LEDs of a first light fixture 100A and the first one of the plurality of LEDs of a second light fixture 10B.

This may be repeated with numerous light fixtures 100 and end-to-end connectors 400 over a long length, for example, over 20 feet. Thus, the width 408 of the spacer 406 may be manufactured in various sizes in accordance with the desired uniform spacing between the plurality of LEDs across multiple light fixtures 100A and 10B.

Figure 6:
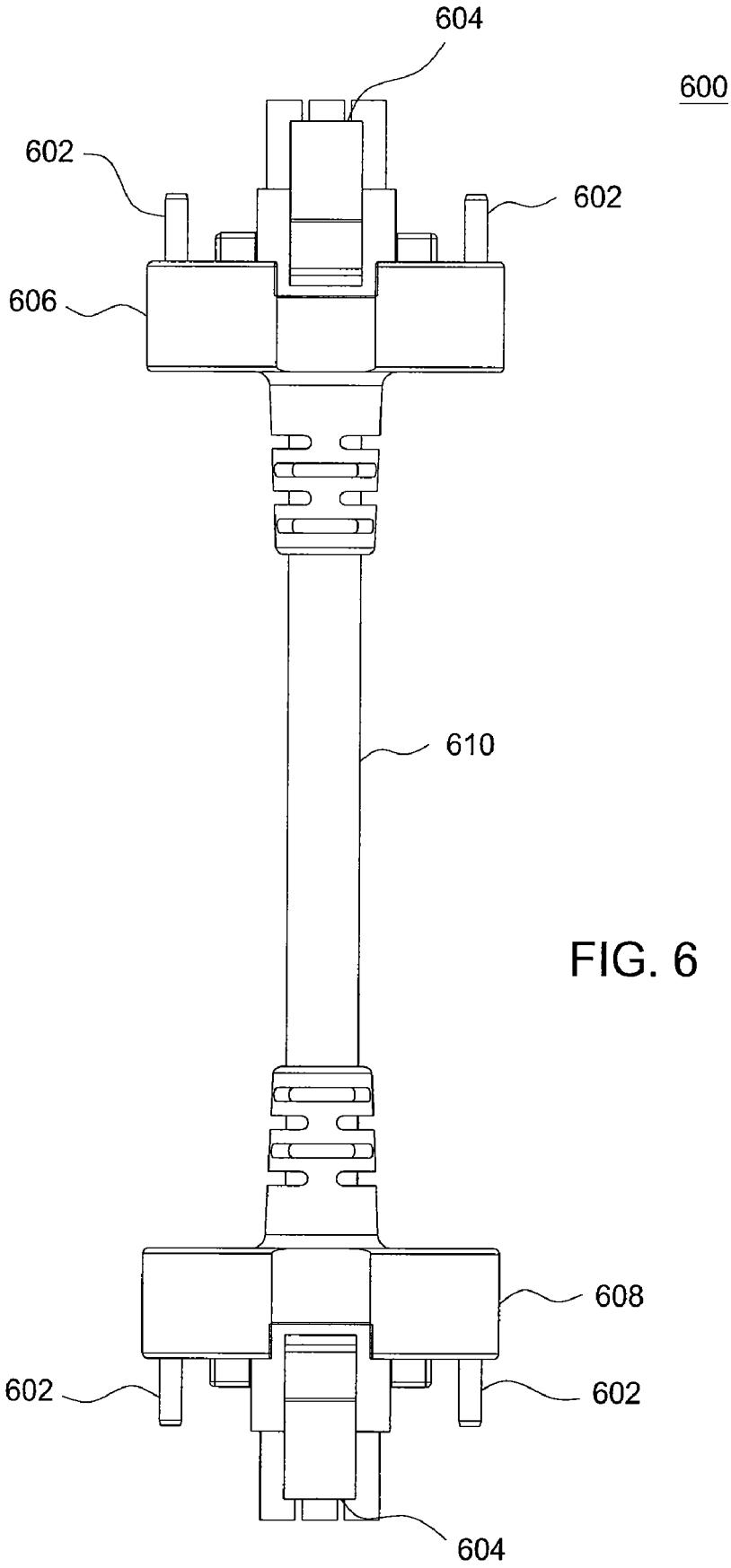
FIG. 6 depicts one embodiment of a flex connector.

FIG. 6 illustrates a second embodiment of an end-to-end connector 600 used with the light fixture 100 described herein. The end-to-end connector 600 includes a first interface 606 for coupling to a first light fixture 100 and a second interface 608 for coupling to a second light fixture 100. The first interface 606 and second interface 608 are coupled to a flexible cord 610. Thus, the end-to-end connector 600 may be used to run parallel rows of light fixtures 100 in conjunction with the end-to-end connector 400 described above.

In one embodiment, the first interface 606 may comprise one or more alignment posts 602 and one or more connecting pins 604. Similar to the end-to-end connector 400, the alignment posts 602 are designed to bear most of stress and weight of the connection to a lighting fixture 100 as the connecting pin 604 may generally be a more delicate piece of hardware. In addition, the alignment posts 602 provide for easier alignment between the end-to-end connector 600 and the light fixture 100. As discussed above, the alignment posts 602 mate with the holes 302. Similarly, the connecting pins 604 mate with the holes 304. As a result, a flush connection is achieved between the light fixture 100 and the end-to-end connector 600. The second interface 608 may also comprise one or more alignment posts 602 and one or more connecting pins 604.

Figure 7:
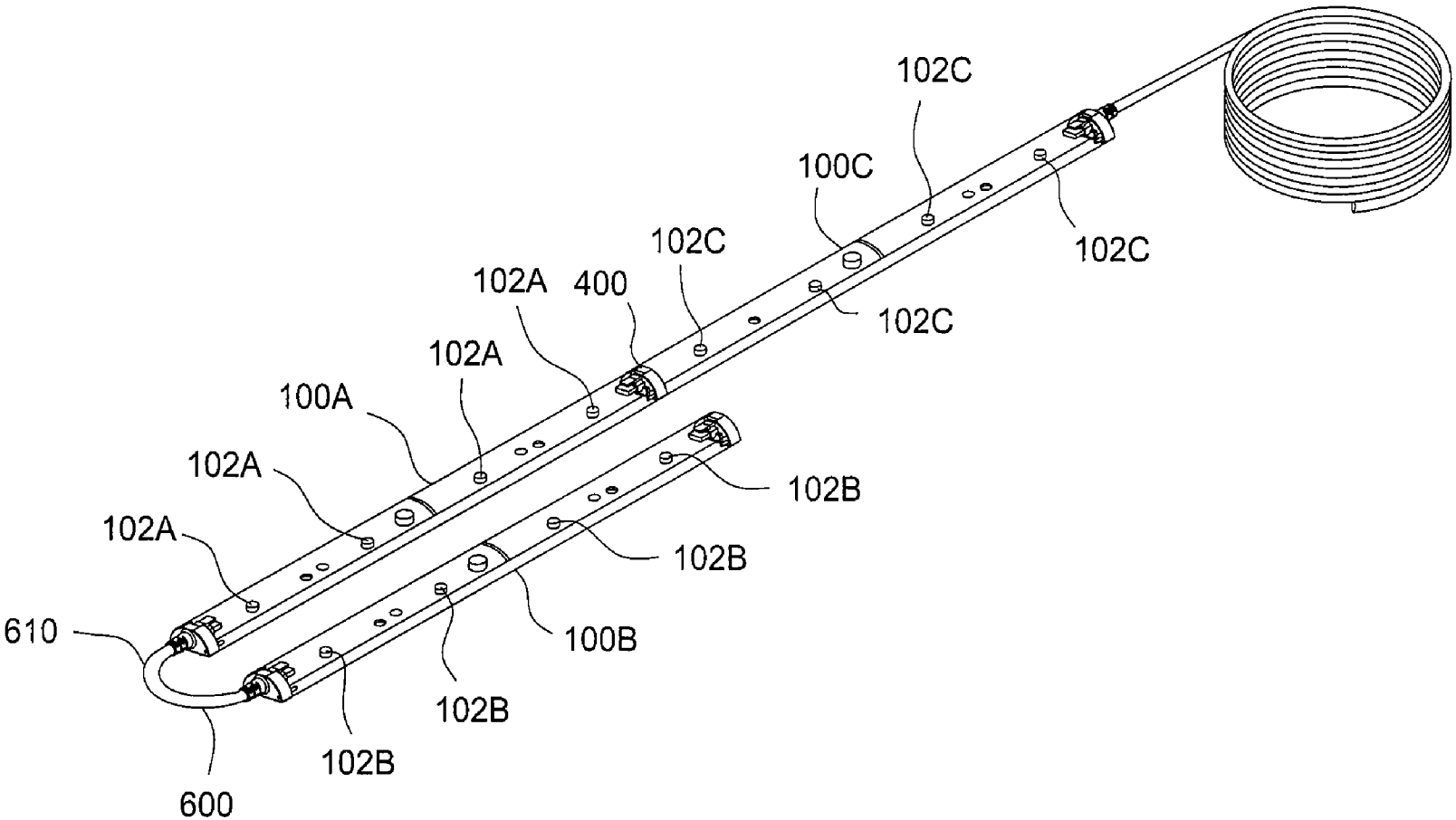
FIG. 7 depicts one embodiment of multiple light fixtures coupled via the end-to-end connector and the flex connector.

The end-to-end connector 600 also serves to maintain uniformity. In one embodiment, the end-to-end connector 600 aligns light fixtures 100 in parallel, as discussed above. For example, this is illustrated by FIG. 7. In FIG. 7, end-to-end connector 600 is coupled to light fixtures 100A and 10B. The flexible cord 610 allows the end-to-end connector 600 to bend, thereby, running light the fixtures 100A and 100B in parallel. Notably, the light fixtures 100A and 100B are aligned vertically. That is each one of the plurality of LEDs 102A are vertically aligned with the LEDs 102B, thus maintaining a symmetric illumination pattern.

In addition, FIG. 7 illustrates the end-to-end connector 400 connected to the light fixture 100A and the light fixture 100C. As discussed above, the end-to-end connector 400 maintains a uniform spacing between the last or furthest right LED 102A of the light fixture 100A and the first or furthest left LED 102C of the light fixture 100C. That is the spacing between each one of the LEDs 102A and 102C is uniform, even between the LED 102A and the LED 102C across the end-to-end connector 400.

Alternatively, the end-to-end connector 600 may be sized to achieve the same functionality as the end-to-end connector 400. In other words, the end-to-end connector 600 may be sized to be used interchangeably with the end-to-end connector 400, if necessary, to maintain a uniform spacing between the plurality of LEDs 102A and 102C.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A light fixture, comprising:

an extrusion;

a plurality of light emitting diodes (LEDs) having a uniform spacing between each one of said plurality of LEDs along said extrusion;

a lens coupled to said extrusion; and one or more mounting holes, wherein each one of the one or more mounting holes travels through said lens and said extrusion as a single hole.

2. The light fixture of claim 1, wherein said extrusion comprises a heat sink.

3. The light fixture of claim 2, wherein a thickness of said heat sink is a function of said uniform spacing between each one of said plurality of LEDs along said extrusion.

4. The light fixture of claim 1, wherein a height of said lens is larger than a height of said extrusion.

5. The light fixture of claim 1, wherein said light fixture is coupled end-to-end with a second light fixture having a second plurality of LEDs.

6. The light fixture of claim 5, wherein said uniform spacing of all LEDs is maintained across said light fixture and said second light fixture.

7. The light fixture of claim 1, wherein said mounting holes are placed relative to said plurality of LEDs to prevent dark spots and maximize optical efficiency on a targeted illumination area.

8. The light fixture of claim 1, wherein said mounting holes are placed relative to said plurality of LEDs to prevent glare from said plurality of LEDs.

9. The light fixture of claim 1, wherein said uniform spacing comprises approximately between 100 millimeters (mm) to 500 mm.

10. The light fixture of claim 1, wherein said lens comprises an optical grade material.

11. The light fixture of claim 1, wherein a ratio of said height of said lens to said height of said extrusion is greater than 1.

12. The light fixture of claim 1, wherein a combined height of said height of said lens plus said height of said extrusion is less than 1 inch (in).

13. The light fixture of claim 1, wherein said lens comprises a mask along a linear edge.

14. The light fixture of claim 1, wherein said lens comprises a pigment.

15. An end-to-end connector for coupling multiple light fixtures, comprising:

a spacer;

a first side coupled to said spacer for coupling to a first light fixture, said first side comprising:

a first one or more connecting pins coupled to said first side of said spacer; and a first one or more alignment posts coupled to said first side of said spacer; and a second side coupled to said spacer for coupling to a second light fixture, said second side comprising:

a second one or more connecting pins coupled to said first side of said spacer; and a second one or more alignment posts coupled to said first side of said spacer, wherein said end-to-end connector maintains said a uniform spacing between a last LED of said first light fixture coupled to said end-to-end connector and a first LED of said second light fixture also coupled to said end-to-end connector, wherein the uniform spacing is consistent with a spacing between a plurality of LEDs of the first light fixture and a plurality of LEDs of the second light fixture.

16. The end-to-end connector of claim 15, wherein a width of said spacer is a function of a uniform spacing between a plurality of light emitting diodes (LEDs) of said first and second light fixture.

17. An end-to-end connector for coupling multiple light fixtures, comprising:

a first interface for coupling to a first light fixture;

a flexible cord coupled to said first interface; and a second interface for coupling to a second light fixture, wherein said end-to-end connector aligns said first light fixture in a first row and said second light fixture in a second row in parallel.

18. The end-to-end connector of claim 17, wherein said end-to-end connector vertically aligns each one of a plurality of light emitting diodes (LEDs) of said first light fixture and each one of a plurality of LEDs of said second light fixture.

* * * * *

UNITED STATES PATENT AND TRADEMARK OFFICE

CERTIFICATE OF CORRECTION

PATENT NO. : 8,231,245 B2
APPLICATION NO. : 12/370871
DATED : July 31, 2012
INVENTOR(S) : David Weimer et al.

It is certified that error appears in the above-identified patent and that said Letters Patent is hereby corrected as shown below:

On Title Page 1, Col. 2 Item (56) (Other Publications), Line 2: Delete "Jun. 15," and insert -- Jun. 16, --, therefor.

In the Specification

Col. 3, Line 7: Delete "a may" and insert -- σ may --, therefor.

Col. 3, Line 17: Delete "a may" and insert -- σ may --, therefor.

Col. 4, Line 46: Delete "10B." and insert -- 100B. --, therefor.

Col. 4, Line 67: Delete "10B." and insert -- 100B. --, therefor.

Col. 5, Line 6: Delete "10B." and insert -- 100B. --, therefor.

Col. 5, Line 35: Delete "10B." and insert -- 100B. --, therefor.

In the Claims

Col. 6, Line 60: In Claim 15, after "maintains" delete "said".

Signed and Sealed this
Eighth Day of July, 2014

Michelle K. Lee

Michelle K. Lee
*Deputy Director of the United States Patent and Trademark Office*